US011406146B2

(12) United States Patent
Takagi et al.

(10) Patent No.: US 11,406,146 B2
(45) Date of Patent: Aug. 9, 2022

(54) GLOVE

(71) Applicant: Showa Glove Co., Himeji (JP)

(72) Inventors: Ryo Takagi, Himeji (JP); Katsuhito Tomono, Himeji (JP); Nobuaki Takahashi, Himeji (JP)

(73) Assignee: SHOWA GLOVE CO., Hyogo (JP)

( * ) Notice: Subject to any disclaimer, the term of this patent is extended or adjusted under 35 U.S.C. 154(b) by 0 days.

(21) Appl. No.: 17/082,470

(22) Filed: Oct. 28, 2020

(65) Prior Publication Data

US 2021/0127766 A1 May 6, 2021

(30) Foreign Application Priority Data

Nov. 1, 2019 (JP) ..... JP2019-200276

(51) Int. Cl.
*A41D 19/00* (2006.01)
*A41D 13/08* (2006.01)

(52) U.S. Cl.
CPC ..... *A41D 19/0044* (2013.01); *A41D 13/08* (2013.01)

(58) Field of Classification Search
CPC ..... A41D 19/0044; A41D 19/0055; A41D 19/0006; A41D 19/02
See application file for complete search history.

(56) References Cited

U.S. PATENT DOCUMENTS 1,735,676 A * 11/1929 Elsey ..... A41D 19/01 2/158
1,791,581 A * 2/1931 Stokes ..... A41D 19/0044 2/162
1,820,847 A * 8/1931 Sullivan ..... A41D 19/0044 2/162
2,018,442 A * 10/1935 Elkus ..... A41D 19/01576 2/169

(Continued)

FOREIGN PATENT DOCUMENTS

JP 2005-023449 A 1/2005

*Primary Examiner* — Jillian K Pierorazio
(74) *Attorney, Agent, or Firm* — Norris McLaughlin, P.A.

(57) ABSTRACT

An object of the present invention is to provide a glove which, while having a cuff, can be easily donned and removed using just one hand. The glove of the present invention includes: a glove main body including a main body portion; 5 finger-receiving portions each having a bottomed cylindrical shape; and a hem portion having a cylindrical shape; and a cuff which is joined to the hem portion of the glove main body, wherein the main body portion is formed in a pouch-like shape to cover a palm and a dorsal side of a wearer's hand, the 5 finger-receiving portions extend from the main body portion to cover each of a first finger to a fifth finger of the wearer, the hem portion extends in a direction opposite to the 5 finger-receiving portions, the cuff is arranged to protrude from the hem portion in a direction opposite to the 5 finger-receiving portions, a projection image of the cuff as viewed from a palm side thereof is a figure symmetrical with respect to a (Continued)

straight line and symmetrical with respect to an axis parallel to a direction of the protruding, the projection increasing in width as it becomes distant from the hem portion, and a flexural rigidity of the cuff is greater than a flexural rigidity of the hem portion of the glove main body, and a difference between the flexural rigidities is no less than 1.0 gf·cm$^2$/cm.

8 Claims, 8 Drawing Sheets

(56) References Cited

U.S. PATENT DOCUMENTS 2,040,052 A * 5/1936 Lammott ..... A41D 19/02 2/169
2,060,342 A * 11/1936 Palickl ..... D06M 15/693 427/389.9
2,210,484 A * 8/1940 Gillian ..... A41D 27/24 2/159
2,217,377 A * 10/1940 Moore ..... A41D 19/01564 2/161.6
2,229,837 A * 1/1941 Claffy ..... A41D 19/0055 2/168
4,445,232 A * 5/1984 Nelson ..... A41D 19/01529 2/16
6,155,084 A * 12/2000 Andrews ..... D02G 3/442 66/174
7,237,273 B2 * 7/2007 Hernandez ..... A41D 19/0017 2/159
2001/0049839 A1 * 12/2001 Kindler ..... A41D 19/01576 2/167
2003/0233695 A1 * 12/2003 Golde ..... A41D 19/015 2/161.1
2009/0044571 A1 * 2/2009 Thompson ..... A41D 19/0096 66/174
2009/0199319 A1 * 8/2009 Jenkin ..... A41D 19/001 2/158
2012/0204604 A1 * 8/2012 Azeem ..... D04B 1/28 66/174
2013/0091618 A1 * 4/2013 Tanaka ..... A41D 19/0065 2/161.8
2014/0157487 A1 * 6/2014 Palese ..... A41D 19/01558 2/161.6
2015/0121598 A1 * 5/2015 Mathews ..... A41D 19/001 2/16
2018/0352881 A1 * 12/2018 Kimbrough ..... A41D 19/01529

* cited by examiner

GLOVE

BACKGROUND OF THE INVENTION

Field of Invention

The present invention relates to a glove.

Description of the Related Art

As a protective glove that can be suitably used in oil work and the like, for example, a glove in which an arm cover portion (a cuff) made of a composite resin is heat-welded to a glove main body having a rubber layer is known (see Japanese Unexamined Patent Application, Publication No. 2005-23449). Wearing such a glove with a cuff enables a wearer's hand and/or arm to be protected from stains and chemical contamination, as well as dangers such as abrasions and the like.

After the aforementioned glove has been donned and work has been performed, the glove is removed by, for example, holding fingertip portions of the glove with another hand (a hand opposite to the hand wearing the glove which the wearer wishes to remove), and pulling the glove in a fingertip direction (a direction opposite to the cuff). However, as oil stains and the like have generally adhered to an outer face of the glove after work, in particular in a case of removing one glove and then removing the other glove, the fingertip portions of the other glove are held with a bare hand, and the bare hand of the wearer cannot be prevented from becoming stained by the stains on the outer face. Alternatively, the glove can be held by a hem portion and removed, but in such a case, stains are prone to adhering to the hem portion, and clothing may be stained by the stains on the hem portion when the wearer once again dons the glove. Furthermore, when stains adhere to the hem portion when the glove is removed, at a time of once again donning the glove, a stain may adhere to the hand opposite to the one to don the glove. Moreover, the glove having a stained hem portion must be used to hold the other glove when placing the other glove onto the opposite hand; consequently, the hem portion may be further stained, or the wearer's clothing may be stained. Accordingly, there is a need for a glove which can be easily donned and removed using just one hand.

PRIOR ART DOCUMENTS

Patent Documents

Patent Document 1: Japanese Unexamined Patent Application, Publication No. 2005-23449

SUMMARY OF THE INVENTION

The present invention has been made in view of the aforementioned circumstances, and an object of the present invention is to provide a glove which, while having a cuff, can be easily donned and removed using just one hand.

The present inventors have carefully investigated the difficulty of donning and removing a glove having a cuff, and have learned that the difficulty is mainly due to two points, described below. The first point is that the cuff is typically prepared to be wider at an arm side than a wrist side by, as illustrated in FIG. 7, cutting an end 101 from a fabric 100 having a strip shape, resulting in a circumference length of an edge 100*a* on the arm side being greater than a circumference length of an edge 100*b* on the wrist side. A cuff 110 (see FIG. 8), made by connecting a pair of sides 100*c* of the fabric 100 having the strip shape shown in FIG. 7, results in a portion 110*a* prone to separating from the arm (arm-separating portion 110*a*), being located near a joining portion 110*c* between the pair of sides 100*c* of the fabric 100; and a portion 110*b* which tends to align with the arm (arm-aligning portion 110*b*) when the glove is donned, located on a side opposite to the arm-separating portion 110*a*. Consequently, the arm-separating portion 110*a* and the arm-aligning portion 110*b* differ in a manner of contacting the arm when the glove is donned and removed. Accordingly, as friction prevents the wearer from easily inserting his/her clothing into the glove at the arm-aligning portion 110*b* when donning the glove, the clothing is prone to becoming stained. Furthermore, sites having unduly high frictional force develop, making it difficult to don and remove the glove. The second point is that in a case in which an outer surface of the glove and an outer surface of the cuff are joined such that they face each other at a joining portion between the glove main body and the cuff, the joining portion juts toward an inner face of the glove. Consequently, at a time of donning or removing the glove, the hand tends to contact an end of the cuff on a glove main body side at a joining site between the cuff and the glove main body. At this joining site in particular, a diameter of the glove often narrows and the end of the cuff tends to slant inward in conjunction with the narrowing, resulting in difficulty in donning and removing the glove due to the hand contacting the end of the cuff, which has bent inward. As a result of further investigation, the present inventors have found that the aforementioned points causing difficulty in donning and removing the glove are overcome by adjusting a shape of the cuff and a flexural rigidity of the cuff and the glove main body, thus completing the present invention.

More specifically, a glove according to an aspect of the present invention includes:

a glove main body having:

a main body portion;

5 finger-receiving portions each having a bottomed cylindrical shape; and a hem portion having a cylindrical shape; and a cuff which is joined to the hem portion of the glove main body, wherein the main body portion is formed in a pouch-like shape to cover a palm and a dorsal side of a wearer's hand, the 5 finger-receiving portions extend from the main body portion to cover each of a first finger to a fifth finger of the wearer, the hem portion extends in a direction opposite to the 5 finger-receiving portions, the cuff is arranged to protrude from the hem portion in a direction opposite to the 5 finger-receiving portions, a projection image of the cuff as viewed from a palm side thereof is a figure symmetrical with respect to a straight line and symmetrical with respect to an axis parallel to a direction of the protruding, the projection image increasing in width as it becomes distant from the hem portion, and a flexural rigidity of the cuff is greater than a flexural rigidity of the hem portion of the glove main body, and a difference between the flexural rigidities is no less than 1.0 $gf \cdot cm^2/cm$.

Because, with regard to the glove according to the aspect of the present invention, the projection image of the cuff as viewed from the palm side thereof is the figure symmetrical with respect to a straight line and symmetrical with respect to the axis parallel to the direction of the protruding, the projection image increasing in width as it becomes distant from the hem portion, the cuff is highly symmetrical in a transverse direction when viewed from the palm side thereof, and increases in width as it approaches a side in which the hand is inserted. In other words, due to employing such a shape, the glove is more likely to have uniform frictional force, regardless of site, at a time of donning or removing the glove. Accordingly, portions having unduly high frictional force are unlikely to develop in the glove, thereby inhibiting the difficulty of donning and removing the glove. Furthermore, in the glove, the flexural rigidity of the cuff is set to be greater than the flexural rigidity of the hem portion of the glove main body by no less than the above-mentioned lower limit. Due to thus setting the flexural rigidity of the cuff to be greater than the flexural rigidity of the hem portion of the glove main body, mainly the hem portion of the glove main body bends inward at a time in which an area around the joining site between the cuff and the glove main body bends inward, and the cuff can be inhibited from bending inward. Thus, it is possible to inhibit the case in which the hand is likely to contact each of the edges at the joining site between the cuff and the glove main body. In view of the aforementioned points, the glove according to the aspect of the present invention is easy to don and remove.

The cuff preferably has a right frustum shape. Thus configuring the cuff to have the right frustum shape enables making portions having unduly high frictional force more unlikely to develop, thereby making the glove even easier to don and remove.

The glove main body preferably includes an inner glove being a fabric which is knitted into a glove shape, the fabric being constituted from a yarn made of fiber; and a coating layer which coats a part or all of an outer face of the inner glove, wherein a principal component of the coating layer is a resin or a rubber, and the coating layer is joined to the cuff on the palm side thereof. The glove can be suitably used in an environment requiring stain prevention, such as oil work and the like. Accordingly, by thus providing on the glove main body the coating layer containing a resin or a rubber as the principal component and joining the coating layer to the cuff on the palm side thereof, a stain prevention effect can be enhanced. Furthermore, the coating layer facilitates imparting a function such as an antislipping property or a waterproofing property to the glove.

The principal component of the coating layer is preferably a nitrile-butadiene rubber or a chloroprene rubber. By thus having the principal component of the coating layer be a nitrile-butadiene rubber, oil resistance can be enhanced at a comparatively low cost.

The cuff is preferably constituted from at least two parts having joining portions which run longitudinally between upper edges and lower edges thereof. When the cuff is thus constituted from the at least two parts having the joining portions which run longitudinally between the upper edges and the lower edges thereof, a state in which the no less than two parts expand toward an outer side, originating at the joining portions, is easily fixed. Accordingly, the glove can be more easily donned and removed.

The glove main body preferably includes a cut-resistant yarn made of a polyaramid, a drawn polyethylene, a metal, or a glass fiber. When the cut-resistant yarn is thus used in the glove main body, a protective ability of the glove with respect to dangers such as cuts, abrasions, and the like can be enhanced.

The glove main body preferably has an organic fiber region which is knitted using a yarn made of organic fiber, wherein the organic fiber region originates at an edge of the hem portion of the glove main body and continues for no less than 1 mm toward a fingertip side thereof. When the edge of the hem portion of the glove main body is thus constituted from the organic fiber, irritation to skin can be reduced compared to a case in which the edge of the hem portion of the glove main body is constituted from inorganic fiber.

The cuff is preferably made of a synthetic leather or an artificial leather. A synthetic leather and an artificial leather each have comparatively high flexural rigidity, and have oil resistance and the stain prevention effect; accordingly, functionality of the glove as a protective glove can be maintained, and the glove can be easily donned and removed.

It is preferable that the glove main body and the cuff are joined by sewing, and that the sewing is overlock sewing. When the overlock sewing is thus used as the sewing between the glove main body and the cuff, irritation resulting from a joining portion therebetween contacting the hand at a time of donning or removing the glove can be reduced, and the hand can be inhibited from becoming caught; accordingly, the glove can be easily donned and removed.

At the joining portion between the glove main body and the cuff, a circumference length of the cuff before the joining is preferably greater than a circumference length of the glove main body before the joining, and a difference between the circumference lengths is preferably no less than 1 mm. When the circumference length on the cuff side is thus greater, ease of donning and removing the glove can be maintained, and the stain prevention effect can be enhanced.

The "right frustum" as referred to herein means a frustum in which a line connecting a center of a circle on a bottom face and a center of a circle on a top face is perpendicular to the bottom face. Furthermore, a cuff having a right frustum shape means that a cuff which is deformable can be arranged to have a right frustum shape. Moreover, "join (ing)" as referred to herein means that two objects have been secured by sewing, adhesion, or the like.

The "flexural rigidity" can be calculated by a pure bending test. Specifically, the flexural rigidity can be measured by a well-known pure bending tester (for example, "KES-FB2," manufactured by Kato Tech Co, Ltd.), and can be calculated, provided that a maximum curvature is +/−2.5 $cm^{-1}$ and the test is repeated five times, based on curvatures of 0.5 $cm^{-1}$ and 1.5 $cm^{-1}$ at a time of convex bending of an outer face side of a glove (concave bending of an inner face side of a glove). As test pieces, a piece being 5 cm×5 cm cut from an unwrinkled portion of the glove main body including the hem portion, and a piece being 5 cm×1 cm cut from the cuff in a longitudinal direction of the glove are used. In order to estimate the flexural rigidity of bending after joining, the test pieces are set such that a circumference length direction of the glove is sandwiched between mounting jigs, and such that a first movement is the outer face side of the glove bending convexly (the inner face side of the glove bending concavely), and the pure bending test is conducted. 5 of the test pieces, i.e., 1 test piece from each of 5 gloves, are prepared in total, and the measurement results are arithmetically averaged together to calculate the flexural rigidity. It is to be noted that in a case in which the hem portion of the glove main body contains multiple parts, such as containing a part being only the inner glove and a part in which the first coating layer has been formed on the inner glove, the test piece is cut from a part accounting for the largest portion with respect to the periphery of the hem portion. In a case in which the test results fall outside of a measurement range of the tester, a width of the test piece is adjusted and the test is once again conducted.

Effects of the Invention

As described above, the glove of the aspect of the present invention, while having a cuff, can be easily donned and removed using just one hand.

DESCRIPTION OF THE PREFERRED EMBODIMENTS

The glove according to an embodiment of the present invention is described in detail hereafter.

Glove

Figure 1:
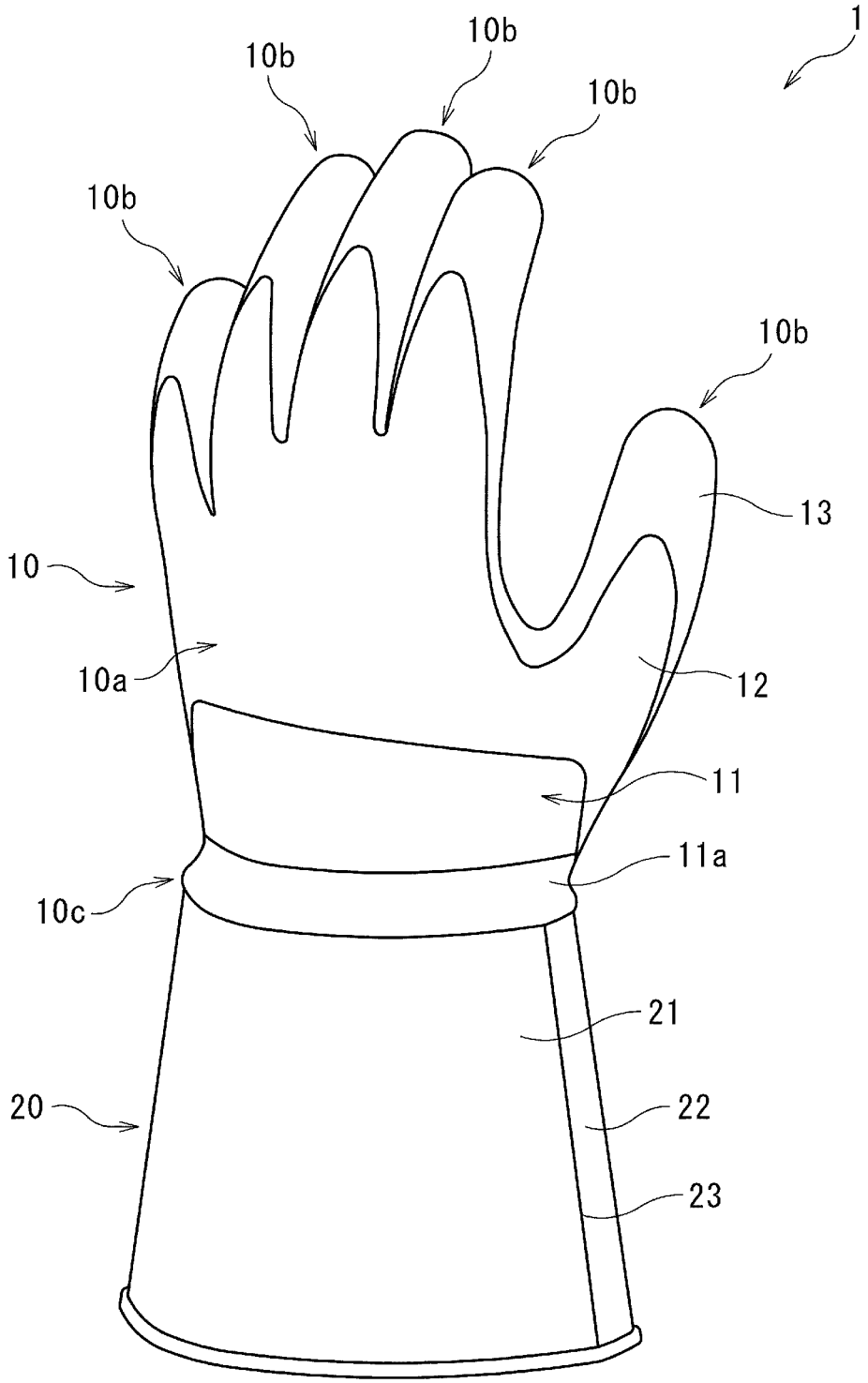
FIG. 1 is a schematic plan view of a glove according to an embodiment of the present invention viewed from a dorsal side thereof.
Figure 2:
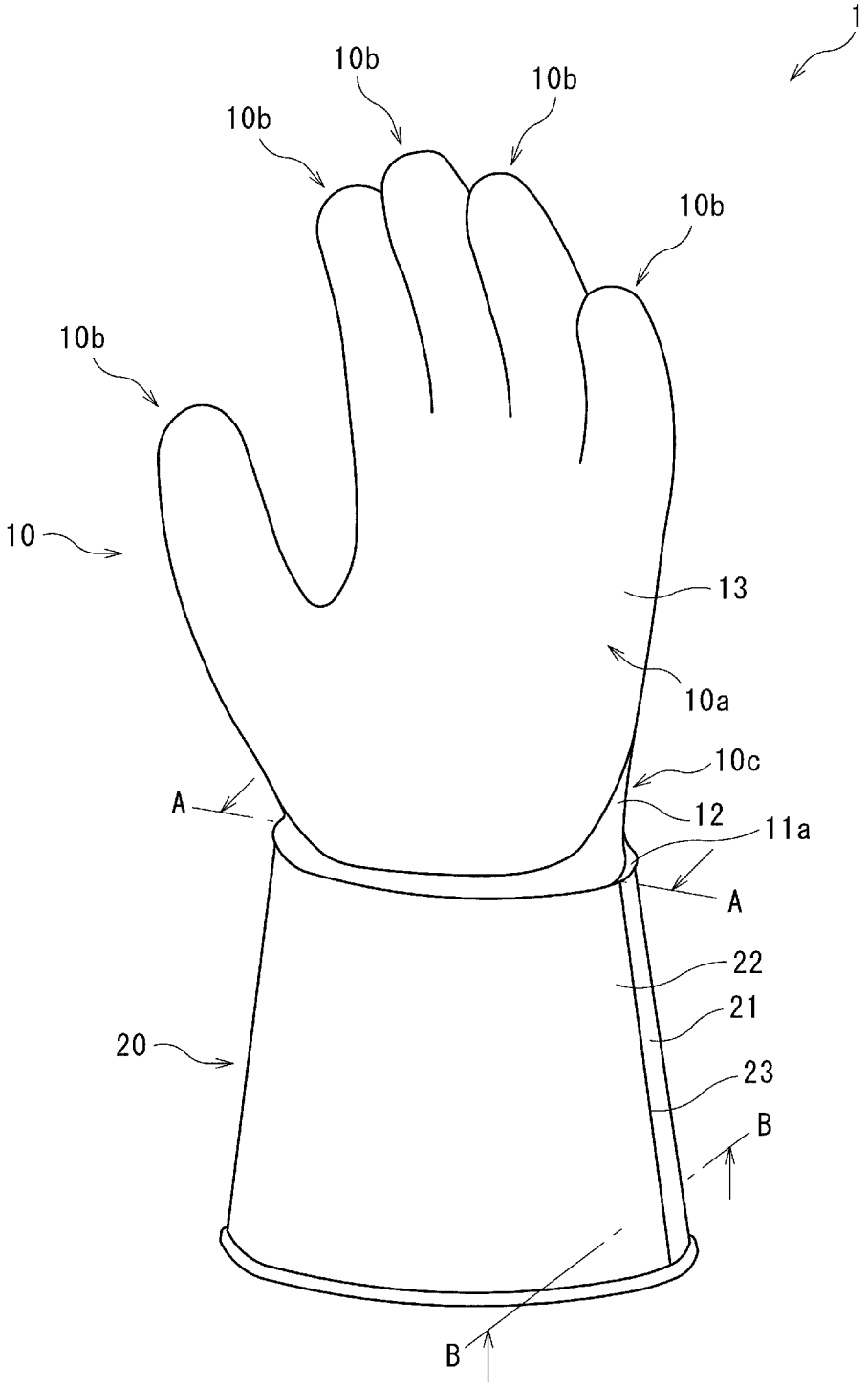
FIG. 2 is a schematic plan view of the glove in FIG. 1 viewed from a palm side thereof.

A glove 1 illustrated in FIGS. 1 and 2 includes a glove main body 10 and a cuff 20.

Glove Main Body

The glove main body 10 includes a main body portion 10*a*, 5 finger-receiving portions 10*b* each having a bottomed cylindrical shape, and a hem portion 10*c* having a cylindrical shape. The main body portion 10*a* is formed in a pouch-like shape to cover a palm and a dorsal side of a wearer's hand, the 5 finger-receiving portions 10*b* each extend from the main body portion 10*a* to cover, respectively, a first finger to a fifth finger of the wearer, and the hem portion 10*c* extends in a direction opposite to the 5 finger-receiving portions 10*b*.

Figure 3:
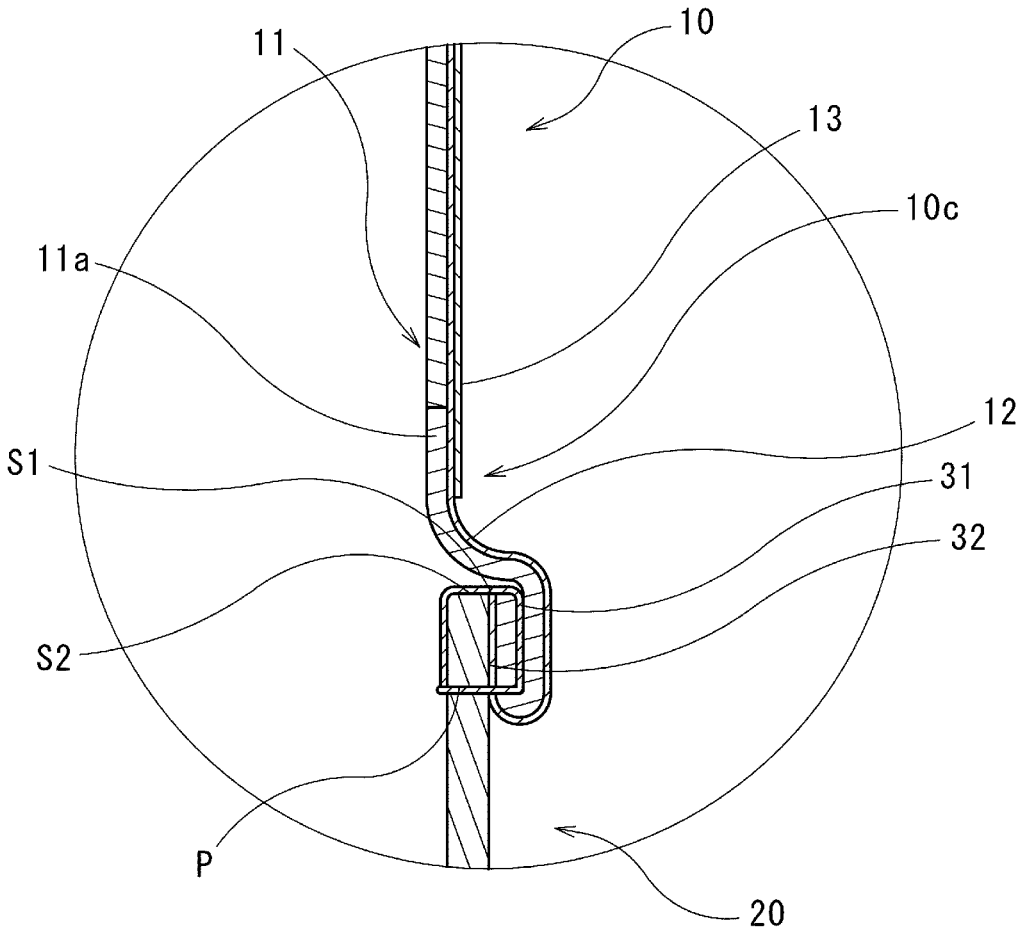
FIG. 3 is a partially enlarged schematic cross-sectional view at an A-A line of the glove in FIG. 2 illustrating the joining portion between the glove main body and the cuff on a palm side.

Furthermore, as illustrated in FIG. 3, when viewed in a thickness direction, the glove main body 10 includes an inner glove 11 constituted from a yarn made of fiber, a first coating layer 12 which coats a part of an outer face of the inner glove 11, and a second coating layer 13 which coats a part of an outer face of the first coating layer 12.

As illustrated in FIG. 3, the glove main body 10 and a cuff 20, described later, are joined by sewing. The joining can be carried out by, for example, a below procedure. As illustrated in FIG. 3, first an edge S1 on a hem portion 10*c* side of the glove main body 10 and an edge S2 on a side of the cuff 20 to be joined to the hem portion 10*c* are layered atop one another such that an outer face side of the glove main body 10 comes in contact with an outer face side of the cuff 20. Specifically, an inside and outside of the cuff 20 are inverted (turned inside out), and, from an outer side of the glove main body 10, an edge of the cuff 20 on an arm side is layered such that it is located on a fingertip side of the glove main body 10, thereby layering the edge S1 on the hem portion 10*c* side of the glove main body 10, and the edge S2 on the side of the cuff 20 to be joined to the hem portion 10*c*. After sewing together the glove main body 10 and the cuff 20 in this state using a sewing thread 31, reverting the inside and outside of the cuff 20 enables a configuration illustrated in FIG. 3 to be obtained.

In the configuration of FIG. 3, the glove main body 10 and the cuff 20 are in contact with one another from the edges (the edge S1 and the edge S2) of the glove main body 10 and the cuff 20 being layered atop one another, to a site at which the sewing thread 31 pierces the glove main body 10 and the cuff 20 (a piercing site P in FIG. 3). This contacting part corresponds to the joining portion 32 between the glove main body 10 and the cuff 20. The joining portion 32 is located in a strip shape around an entire periphery along the edge S1 of the hem portion 10*c* of the glove main body 10 (the edge S2 on the glove main body 10 side of the cuff 20).

The sewing is preferably overlock sewing. The overlock sewing may be carried out using an overlock sewing machine, an interlock sewing machine, or the like. When the sewing is carried out by overlock sewing, as illustrated in FIG. 3, the edges of the glove main body 10 and the cuff 20 being layered atop one another are locked such that they are enclosed by the sewing thread 31. When overlock sewing is thus used as the sewing between the glove main body 10 and the cuff 20, irritation resulting from the joining portion 32 contacting the hand at a time of donning or removing the glove 1 can be reduced, and a case of the hand becoming caught can be inhibited; accordingly, the glove 1 can be easily donned and removed.

Furthermore, the glove main body 10 is cut at the hem portion 10*c* at a time of production, thereby adjusting a length thereof. Consequently, in the aforementioned state, a fiber of the inner glove 11 may fray at the edge on the hem portion 10*c* side. With overlock sewing, the edges are enclosed by the sewing thread 31; accordingly, overlock sewing is effective at preventing such fraying as well.

Furthermore, in a case of using a cut-resistant yarn, described later, as the fiber of the inner glove 11, the cut-resistant yarn tends to protrude from the edge on the hem portion 10*c* side, and skin of the hand may be irritated by the cut-resistant yarn thus protruding, resulting in an unpleasant feeling. When overlock sewing is employed to address this, locking is enabled such that the edge on the hem portion 10*c* side is enclosed, enabling reduction of the unpleasant feeling.

As the sewing thread 31 used in the overlock sewing, a looper thread and a needle thread are used. The lower limit of a total fineness of the looper thread is preferably 200 dtex, and more preferably 300 dtex. When the total fineness of the looper thread is less than the lower limit, it may not be possible to sufficiently enclose the edges. Meanwhile, the upper limit of the total fineness of the looper thread is not particularly limited, and the total fineness of the looper thread is, for example, no greater than 1,500 dtex. Furthermore, a total fineness of the needle thread may be set to the same range as the looper thread.

The lower limit of a stitch length of the overlock sewing is preferably 0.5 mm, and more preferably 0.7 mm. Meanwhile, the upper limit of the stitch length is preferably 3 mm, more preferably 2 mm, and still more preferably 1.5 mm. When the stitch length is less than the lower limit, strength of the glove main body 10 and/or the cuff 20 may be degraded due to a large number of holes being created in the hem portion 10*c* of the glove main body 10 or the cuff 20 by the needle piercing multiple times during the sewing. Conversely, when the stitch length is greater than the upper limit, it may not be possible to sufficiently enclose the edges, and adhesiveness between the hem portion 10*c* of the glove main body 10 and the cuff 20 at the joining portion 32 may be degraded. It is to be noted that regarding the stitch length of the overlock sewing, the length being lower enables increasing the adhesiveness between the hem portion 10*c* and the cuff 20 by tension of the sewing thread 31, and facilitates preventing protrusion of the cut-resistant yarn from the edge of the hem portion 10*c* by the looper thread.

A number of times of conducting the sewing may be adjusted in accordance with a state of the enclosing of the edges; the sewing may be conducted once, and is preferably conducted multiple times. Furthermore, an overedge width in the overlock sewing is not particularly limited, and in light of, for example, ease of enclosing the edges, is preferably no less than 3 mm and no greater than 10 mm. Accordingly, even in a case in which a misalignment occurs between the edge of the glove main body 10 and the edge of the cuff 20, it is possible to join both edges.

Inner Glove

The inner glove 11 is a fabric which is knitted into a glove shape, the fabric being constituted from a yarn made of fiber. Specifically, the inner glove 11 is knitted into the glove shape by seamless knitting, or by sewing a knitted fabric, a woven fabric, or a nonwoven fabric. Furthermore, the inner glove 11 includes the main body portion 10*a*, the 5 finger-receiving portions 10*b*, and the hem portion 10*c*, and has a shape similar to an overall shape of the glove main body 10.

The fiber of the yarn to be used for the inner glove 11 can be exemplified by known synthetic fibers, natural fibers, special fibers, and the like.

Examples of the synthetic fibers include a nylon, a polyester, an acryl, a polypropylene, a polyethylene, a polyaramid, a rayon, and the like. Examples of the natural fibers include cotton, hemp, silk, and the like. Examples of the special fibers include a glass fiber, a metal fiber of, e.g., stainless steel or tungsten, and the like.

It is preferred that for the fibers of the yarn to be used in the inner glove 11, a fiber selected from a polyaramid, a drawn polyethylene, a glass fiber, and a metal fiber is used in at least a part thereof. Such yarns are cut-resistant yarns enabling cut-resistance to be improved with respect to fineness. In other words, the glove main body 10 preferably includes a cut-resistant yarn made of a polyaramid, a drawn polyethylene, a metal, or a glass fiber. When a cut-resistant yarn is thus used in the glove main body 10, the protective ability of the glove 1 with respect to dangers such as cuts, abrasions, and the like can be enhanced. Furthermore, of these, including a cut-resistant yarn made of a metal or a glass fiber, each having high cut resistance, is further preferable.

The glove main body 10 includes, in the inner glove 11, an organic fiber region 11*a* knitted using a yarn made of organic fiber. The organic fiber region 11*a* is formed in a strip shape on an end of the hem portion 10*c*, and is arranged around the entire periphery of the hem portion 10*c*. The organic fiber region 11*a* is strip-shaped and constituted only from organic fiber, including no inorganic fiber therein. The organic fiber can be exemplified by the above-described synthetic fibers, natural fibers, and the like. Meanwhile, the inorganic fiber can be exemplified by the above-described special fibers, e.g., a glass fiber and a metal fiber, and the like.

The organic fiber region 11*a* is preferably formed at least one knit or weave toward the fingertip side of the glove main body 10, from the edge of the hem portion 10*c* of the glove main body 10. Specifically, the organic fiber region 11*a* originates at the edge of the hem portion 10*c* of the glove main body 10 and continues for preferably no less than 1 mm toward the fingertip side, and more preferably no less than 3 mm toward the fingertip side. At the edge of the glove main body 10, there may be a case in which an end of the fiber which has been cut is exposed. When the end is constituted from inorganic fiber, it is more likely to cause irritation to skin. In contrast, by constituting the edge of the hem portion 10*c* of the glove main body 10 from organic fiber, irritation to skin can be reduced compared with the case in which the edge of the hem portion 10*c* of the glove main body 10 is constituted from the inorganic fiber. It is to be noted that the distance originating at the hem portion 10*c* and continuing toward the fingertip side means a distance which continues along an outer face side of the organic fiber region 11*a*. Accordingly, in a case of a curvature at the end of the hem portion 10*c* of the glove main body 10, as shown in the organic fiber region 11*a* illustrated in FIG. 3, the above-mentioned distance which the organic fiber region 11*a* continues (continuation distance) means the length of a path from the edge of the hem portion 10*c* along a tip of a curved portion of the hem portion 10*c* (the lower edge of the joining portion 32 in FIG. 3) toward the fingertip side.

Meanwhile, the upper limit of the continuation distance of the organic fiber region 11*a* originating at the edge of the hem portion 10*c* of the glove main body 10 toward the fingertip side is preferably 30 mm, more preferably 20 mm, still more preferably 15 mm, and particularly preferably 10 mm. When the continuation distance is greater than the upper limit, the abilities imparted to the inner glove 11 may be insufficient at the hem portion 10*c*. In other words, in the case in which, for example, the cut-resistant yarn and/or the special fibers are used as the yarn to knit the inner glove 11, it may be difficult to secure the necessary cut-resistance or abrasion resistance for the glove main body 10.

Furthermore, in the case in which the glove main body 10 and the cuff 20 are joined by sewing, the organic fiber region 11*a* preferably continues for no less than 1 mm from the site at which the sewing thread 31 pierces the glove main body 10 and the cuff 20 (in a case of multiple sites, a site nearest the fingertip side) toward the fingertip side. By thus constituting a certain range from the site pierced by the sewing thread 31 with the organic fiber, a difference between the flexural rigidity of the cuff 20, described later, and the flexural rigidity of the hem portion 10*c* of the glove main body 10 can be easily secured. Accordingly, the glove 1 can be more easily donned and removed.

Coating Layer

A principal component of the first coating layer 12 and the second coating layer 13 is a resin or a rubber. The glove 1 can be suitably used in an environment requiring stain prevention, such as oil work and the like. Accordingly, by thus providing, on the glove main body 10, the coating layer(s) containing a resin or a rubber as the principal component, the stain prevention effect can be enhanced.

Furthermore, the coating layer(s) facilitate(s) imparting a function such as an antislipping property or a waterproofing property to the glove 1. With regard to the glove 1, the waterproofing property is imparted by the first coating layer 12, and the antislipping property is imparted by the second coating layer 13.

The principal component of the coating layer(s) is appropriately determined in accordance with functions to be imparted, and examples of the resin include polyvinyl chloride, polyurethane, an ethylene-vinyl alcohol copolymer (EvOH), polyvinyl alcohol (PVA), and the like. Furthermore, examples of the rubber include a nitrile-butadiene rubber, a chloroprene rubber, a natural rubber, a fluorine rubber, a silicone rubber, and the like. Of these, the principal component of the coating layer(s) is preferably a nitrile-butadiene rubber or a chloroprene rubber. By thus having the principal component of the coating layer(s) be a nitrile-butadiene rubber or a chloroprene rubber, the oil resistance can be enhanced at a comparatively low cost.

The coating layer(s) is/are preferably joined to the cuff 20 on the palm side thereof. In the glove 1, the first coating layer 12 is joined such that it contacts an outer face of the cuff 20. When the coating layer(s) is/are thus joined to the palm side of the cuff 20, the stain prevention effect can be further enhanced.

At this time, it is not necessary for the coating layer(s) joined to the cuff 20 (the first coating layer 12) to be joined to the cuff 20 along an entirety of the palm side. The lower limit of a length (joining length) at which the first coating layer 12 is joined to the cuff 20 on the palm side of the glove main body 10 in the joining portion is, with respect to the half of the circumference length being on the palm side, preferably ½, more preferably ⅔, and still more preferably ¾. When the joining length between the first coating layer 12 and the cuff 20 is less than the lower limit, for example, at a time at which liquid stains such as water and/or oil drip down from the palm side, it may not be possible to sufficiently inhibit permeation into an inner face of the glove main body 10. Meanwhile, an upper limit of the joining length between the first coating layer 12 and the cuff 20 is not particularly limited, and the first coating layer 12 may be joined to the cuff 20 along an entire periphery, including the dorsal side thereof. When the coating layer(s) is/are thus joined to the cuff 20 along the entire periphery, penetration of liquids can be inhibited with a high degree of certainty.

As described above, the first coating layer 12 is a coating layer for imparting the waterproofing property to the glove 1. In the glove 1 as illustrated in FIGS. 1 and 2, the first coating layer 12 is formed on an entire surface of the glove main body except for a part of the hem portion 10*c* on the dorsal side thereof, but the first coating layer 12 is acceptable as long as it is formed such that it enables maintaining the waterproofing property on at least the palm sides of the main body portion 10*a* and the finger-receiving portions 10*b*, as well as on the dorsal side of half of a fingertip side of each of the finger-receiving portions 10*b*. Accordingly, assuming a typical state of usage, the first coating layer 12 is able to cover parts of the glove 1 which come into contact with items to be gripped. Furthermore, if the first coating layer 12 is formed continuously from the finger-receiving portions 10*b* to the joining portion 32 with the cuff 20, the penetration of liquids can be inhibited with a high degree of certainty.

As described above, the second coating layer 13 is a coating layer for imparting the antislipping property to the glove 1. A method for imparting the antislipping property may be exemplified by a method in which irregularities are applied to an outer surface which includes particles; a method in which a foam layer is used as the second coating layer 13; a method in which, at a time of producing the second coating layer 13, deliquescent particles are applied on an antislipping layer before curing and are removed following heating, thereby forming concave shapes; a method in which, at the time of producing the second coating layer 13, the second coating layer 13 is swollen using a solvent and an irregular pattern is applied; and the like. Of these, in light of creating a gap inside the second coating layer 13 and improving flexibility, the method in which the foam layer is used, or the method in which the deliquescent particles are used is preferred.

The coating layer may be formed by a production method including a step (a coagulating agent-dipping step) of dipping the inner glove 11 in a coagulating agent; and a step (a heat-hardening step) of dipping the inner glove 11, which has been dipped in the coagulating agent, in a raw material compound containing a resin or rubber composition, and conducting heating to harden the raw material compound adhered on the inner glove 11 by the dipping, thereby forming the coating layer. The coagulating agent-dipping step and the heat-hardening step are carried out for each coating layer. More specifically, the second coating layer 13 is formed after the first coating layer 12 has been formed. As another method, a method in which a water-repelling treatment, an oil-repelling treatment, or both are carried out on the inner glove 11, a raw material compound is applied thereon, and hardening is carried out by heating, may be used.

In the coagulating agent-dipping step, the inner glove 11 is fitted onto a hand mold, and desired sites of the inner glove 11, such as the palm and/or the fingertips thereof, or all of the inner glove 11, are dipped in the coagulating agent. Examples of the coagulating agent include sodium chloride, calcium chloride, calcium nitrate, acetic acid, citric acid, and the like. These may be used either alone of one type, or in a combination of two or more types thereof. Of these, in light of obtaining a coagulating effect in a short time period, the calcium nitrate is preferred. Moreover, examples of the solvent for the coagulating agent include methanol, water, and the like.

In the heat-hardening step, after the coagulating agent in excess has been sufficiently dripped off, the desired sites of the inner glove 11, such as the palm and/or the fingertips thereof, or all of the inner glove 11, are dipped in the raw material compound containing the composition of the resin or the rubber, and the raw material compound adhered on the inner glove 11 by the dipping is hardened by heating, thereby forming the coating layer. It is to be noted that the composition of the resin or the rubber is the principal component of the coating layer. It is also to be noted that in the case of forming the second coating layer 13 having the antislipping property, the antislipping property is imparted to the second coating layer 13 in the heat-hardening step by, for example, one of the methods described above.

Cuff

The cuff 20 is arranged and joined such that it protrudes from the hem portion 10*c* of the glove main body 10 in the direction opposite to the 5 finger-receiving portions 10*b*. The cuff 20 has a right frustum shape.

Due to the cuff 20 having the right frustum shape, a projection image of the cuff 20 as viewed from the palm side thereof is a figure symmetrical with respect to a straight line and symmetrical with respect to an axis parallel to the direction of the protruding of the cuff 20, the projection image increasing in width as it becomes distant from the hem portion 10*c*, i.e., the width gradually increasing along a direction of the protruding of the cuff 20. With regard to the glove 1, the projection image has an isosceles trapezoid shape. Thus configuring the cuff 20 such that the projection image has the isosceles trapezoid shape enables making parts having unduly high frictional force more unlikely to develop, thereby making the glove 1 easier to don and remove.

Figure 4:
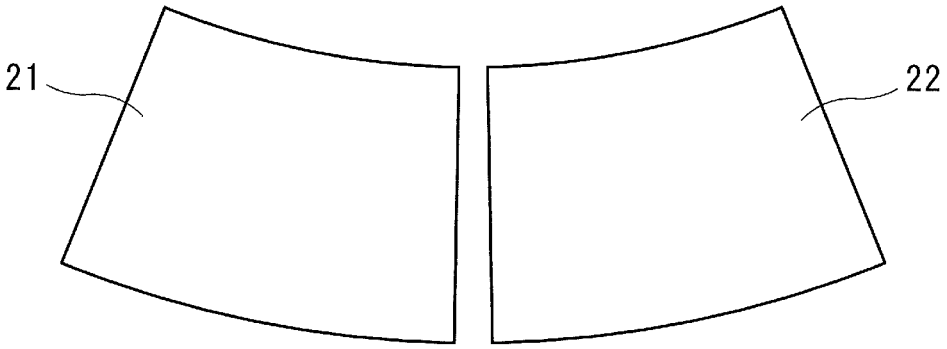
FIG. 4 is a development view of a first part and a second part constituting the cuff in FIG. 1.

The cuff 20 is constituted from two parts (a first part 21 and a second part 22). As illustrated in FIG. 4, the first part 21 and the second part 22 are identical to each other in shape, each having a strip shape, and a pair of edges thereof which form an upper edge and a lower edge of the cuff 20 are constituted from a part of an arc of a concentric circle. The first part 21 and the second part 22 are formed in a cylindrical shape by joining each of pairs of sides thereof. In other words, the two parts have a pair of joining portions 23 which run longitudinally between the upper edge and the lower edge of the cuff 20. The pair of joining portions 23 are arranged such that they face one another and hold therebetween a central axis of the cuff 20, which has a right frustum shape. When the cuff 20 is thus constituted from the two parts (the first part 21 and the second part 22) having the pair of joining portions 23 which run longitudinally between the upper edge and the lower edge, a state in which the two parts expand toward an outer side, originating at the joining portions 23, is easily fixed. In other words, the cuff 20 is easily stabilized in the right frustum shape. Accordingly, the glove 1 can be more easily donned and removed.

Figure 5:
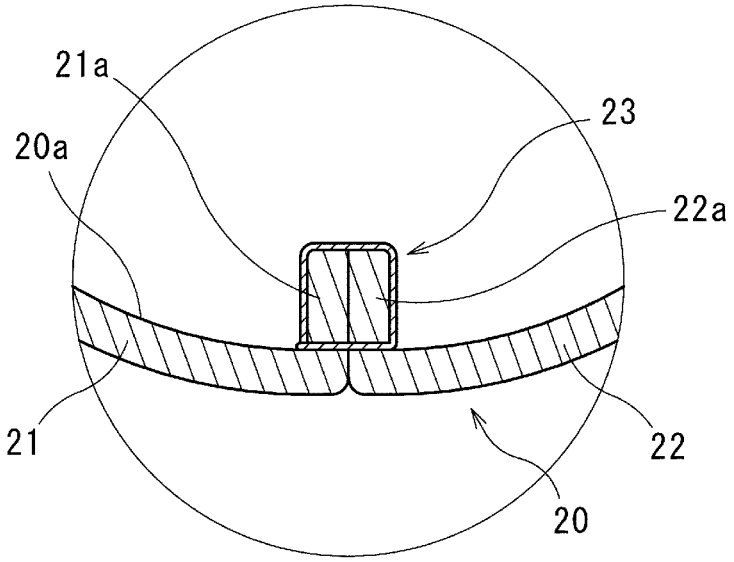
FIG. 5 is a partially enlarged schematic view at a B-B line of the glove in FIG. 2 illustrating a structure of a joining portion of the cuff.

As illustrated in FIG. 5, in each of the joining portions 23, an end 21*a* of the first part 21 and an end 22*a* of the second part 22 are each folded toward an inner face 20*a* of the cuff 20 such that an outer face of each of the end 21*a* and the end 22*a* contact one another, and are joined together. In other words, each of the joining portions 23 protrudes toward the inner face 20*a* of the cuff 20.

As illustrated in FIGS. 1 and 2, the joining portions 23 are preferably arranged in a direction of a generatrix of a frustum. When the joining portions are arranged in the direction of the generatrix, lengths of the joining portions 23 can be shortened, thereby facilitating forming the cuff 20 in the right frustum shape.

A joining method of the joining portions 23 is not particularly limited, and a method similar to the joining methods for the joining portion 32 between the glove main body 10 and the cuff 20 may be used. Of these, the joining method of the joining portions 23 is preferably the sewing by means of the overlock sewing. Accordingly, irritation resulting from the joining portions 23 contacting the hand at a time of donning or removing the glove 1 can be reduced, and due to possessing appropriate rigidity, the cuff 20 can be easily stabilized in the right frustum shape.

Examples of the cuff 20 include a synthetic leather, an artificial leather, or the like, wherein a surface thereof, being a knitted fabric, a woven fabric, or a nonwoven fabric, is coated by a resin or a rubber. In the case of using a synthetic leather or an artificial leather as the cuff 20, the coating face is arranged as an outer face of the cuff 20.

For the fabric, a fiber similar to the yarn used for the inner glove 11 may be used. Furthermore, the resin or the rubber used for the coating may be similar to that used for the first coating layer 12. Of these, in light of ease of processing, the resin is preferably polyvinyl chloride or polyurethane, and the rubber is preferably a nitrile rubber or a chloroprene rubber.

The cuff 20 is preferably made of a synthetic leather or an artificial leather. A synthetic leather and an artificial leather each have comparatively high flexural rigidity, and have oil resistance and the stain prevention effect; accordingly, the functionality of the glove 1 as a protective glove can be maintained, and the glove 1 can be easily donned and removed.

At a joining portion 32 between the glove main body 10 and the cuff 20, a circumference length of the cuff 20 before the joining is greater than a circumference length of the glove main body 10 before the joining. When the circumference length on the cuff 20 side is thus made longer, adhesiveness between the glove main body 10 and the cuff 20 is improved; accordingly, liquid stains such as water and/or oil are less likely to penetrate into the inner face, and the glove 1 is easily donned and removed.

The lower limit of a difference between the circumference lengths in the joining portion 32 between the glove main body 10 and the cuff 20 (subtracting the circumference length of the glove main body 10 before the joining from the circumference length of the cuff 20 before the joining) is preferably 1 mm, more preferably 3 mm, and still more preferably 5 mm. Meanwhile, the upper limit of the difference between the circumference lengths depends on stretchability of the hem portion 10*c* of the glove main body 10. For example, in a case in which a knitted structure is contained in a part of the circumference of the hem portion 10*c*, because stretching occurs with weak force, the upper limit of the difference between the circumference lengths is preferably 70 mm, and more preferably 50 mm. Furthermore, in a case in which all of the periphery of the hem portion 10*c* contains the first coating layer 12, because a comparatively strong force is required for stretching, the upper limit is preferably 20 mm, more preferably 15 mm, and still more preferably 12 mm. When the difference between the circumference lengths is less than the lower limit, the joining may become difficult, and there may be a surplus of fabric of the hem portion 10*c* with respect to the joining portion 32, possibly creating a tuck and causing liquid stains to penetrate into the inner face. Conversely, when the difference between the circumference lengths is greater than the upper limit, a force of the glove main body 10 attempting to contract may increase, thereby making the cuff 20 prone to folding inward and degrading the donning/removing performance of the glove 1.

Figure 8:
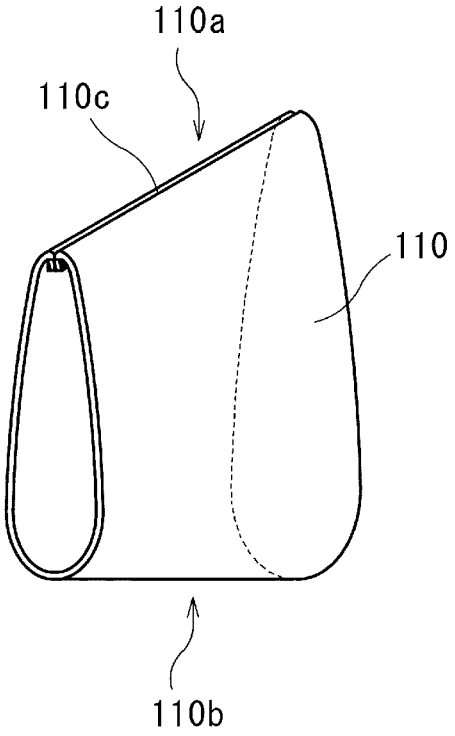
FIG. 8 is a schematic perspective view illustrating a shape of the conventional cuff.

A circumference length of the lower edge of the cuff 20 is greater than a circumference length of the upper edge thereof. As illustrated in FIG. 8, the conventional cuff 110 has the arm-separating portion 110*a* and the arm-aligning portion 110*b*, and symmetry of the cuff 110 is poor. In such a conventional cuff 110, owing to symmetry of the shape being poor, further increasing a difference between the circumference length of the lower edge and the circumference length of the upper edge would further worsen the symmetry, making the cuff 110 prone to causing hindrance during work. Accordingly, the difference between the circumference length of the lower edge and the circumference length of the upper edge must be made relatively small, which tends to result in poor donning/removing performance. In contrast, in the glove 1 according to the embodiment of the present invention, the cuff 20 has a right frustum shape; accordingly, the difference between the circumference length of the lower edge and the circumference length of the upper edge can be comparatively increased, thereby enabling improvement of the donning/removing performance of the glove 1.

The lower limit of the difference between the circumference length of the lower edge and the circumference length of the upper edge of the cuff 20 is preferably 6 cm, and more preferably 7 cm. When the difference between the circumference lengths is less than the lower limit, an effect of improving the donning/removing performance may be insufficient. Meanwhile, the upper limit of the difference between the circumference lengths is not particularly limited, and in light of preventing a decline in workability, may be, for example, no greater than 15 cm.

The lower limit of a length of the cuff 20 (a height of the right frustum) is preferably 4 cm, more preferably 5 cm, and still more preferably 6 cm. Meanwhile, the upper limit of the length of the cuff 20 is preferably 15 cm, and more preferably 10 cm. When the length of the cuff 20 is less than the lower limit, the workability of the glove 1 may be degraded, owing to a diameter of the cuff 20 drastically increasing. Conversely, when the length of the cuff 20 is greater than the upper limit, the workability of the glove 1 may be degraded, owing to the cuff 20 being prone to contacting an elbow joint of the wearer.

Furthermore, in the glove 1, the difference between the circumference length of the upper edge and the circumference length of the lower edge of the cuff 20 can be comparatively increased. In other words, even in the case of increasing the circumference length of the lower edge of the cuff 20, the circumference length of the upper edge thereof can be comparatively decreased. Meanwhile, a circumference length at a narrowest portion of the glove main body 10 (a site at which the circumference length of the glove main body 10 is minimal), which is in proximity to a wrist of the wearer, being relatively narrow makes the hand of the wearer more unlikely to shift within the glove 1. In the glove 1, even if widening of the circumference length from the narrowest portion of the glove main body 10 to the joining portion 32 is comparatively small, the circumference length of the lower edge of the cuff 20 can be increased, achieving favorability of both workability and the donning/removing property. It is to be noted that in the case of a conventional glove, it is necessary to enlarge the narrowest portion, the hem portion, and the upper edge of the cuff together in order to increase the circumference length of the lower edge of the cuff; in such a case, workability deteriorates. Conversely, in order to improve the workability of the glove while maintaining the donning/removing property, in general, it is necessary to increase the circumference length from a wrist portion to the hem portion. In the conventional glove having such a configuration, a portion of the glove main body in proximity to the wrist of the wearer, being the narrowest portion of the glove main body, will fold over and the cuff will shift during work, thereby degrading the workability. In contrast, the glove 1 according to the embodiment of the present invention improves the donning/removing property while maintaining the workability, as described above.

The upper limit of a difference between the circumference length of the narrowest portion of the glove main body 10 and the circumference length of the upper edge of the cuff 20 is preferably 6 cm, and more preferably 4 cm. When the difference between the circumference lengths is greater than the upper limit, an effect of preventing shifting of the cuff 20 may be insufficient. Meanwhile, the lower limit of the difference between the circumference lengths is not particularly limited, and is, for example, 0 cm, so that the donning/removing property of the glove 1 is not degraded.

The upper limit of a distance from the narrowest portion of the glove main body 10 to the upper edge of the cuff 20 is preferably 10 cm, and more preferably 7 cm. When the distance is greater than the upper limit, the donning/removing performance of the glove 1 may be degraded. Meanwhile, the lower limit of the distance is not particularly limited, and may be 0 cm, but is preferably 1 cm.

The lower limit of the flexural rigidity of the cuff 20 is preferably 3.0 gf $cm^2$/cm, and more preferably 4.0 gf·$cm^2$/cm. When the flexural rigidity of the cuff 20 is less than the lower limit, the hand may be more likely to become caught when donning or removing the glove 1, owing to difficulty in maintaining three-dimensionality of the cuff 20. Meanwhile, the upper limit of the flexural rigidity of the cuff 20 is not particularly limited, and is typically 20 gf·$cm^2$/cm, for example, as joining the cuff 20 and the glove main body 10 becomes difficult when the cuff 20 is too stiff.

The flexural rigidity of the cuff 20 is greater than the flexural rigidity of the hem portion 10*c* of the glove main body 10. The lower limit of a difference between the flexural rigidity of the cuff 20 and the flexural rigidity of the hem portion 10*c* of the glove main body 10 is typically 1.0 gf $cm^2$/cm, and preferably 1.5 gf·$cm^2$/cm. When the difference is less than the lower limit, the hand may be more likely to become caught when donning or removing the glove 1, owing to the joining portion 32 between the glove main body 10 and the cuff 20 being more likely to incline inwardly more greatly than a side face of the right frustum. Meanwhile, the upper limit of the difference is not particularly limited, and is typically 15 gf $cm^2$/cm, for example, as joining the cuff 20 and the glove main body 10 becomes difficult when the cuff 20 is too stiff.

Donning/Removing Procedure of Glove

The glove 1 according to the embodiment of the present invention can be donned similarly to a conventional glove. In other words, the glove 1 can be easily donned by inserting a hand into an opening on a lower edge side of the cuff 20.

As a method for removing the glove 1, for example, a method in which an arm is swung forcefully downward can be used. As the glove 1 is unlikely to develop portions having unduly high frictional force, the glove 1 can be pulled from the hand by centrifugal force commensurate with a forceful swing of the hand.

Alternatively, as another method for removing the glove 1, for example, the palm of the glove 1 can be pressed on a flat surface such as a table or the like, and the hand can be pulled from the glove 1. As the glove 1 is unlikely to develop portions having unduly high frictional force, by pressing the palm with a certain degree of force on the raised surface, a frictional force between the flat surface and the palm of the glove 1 can be made to exceed a frictional force between the hand of the wearer and the inner face of the glove 1. Accordingly, the hand alone can be pulled from the glove 1 while the glove 1 remains secured to the flat surface.

Furthermore, as the glove 1 lies on the flat surface after the hand has been pulled therefrom, with the opening of the lower edge of the cuff 20 thereof being in a three-dimensionally open state, and the glove 1 is unlikely to develop portions having unduly high frictional force, it is easy to once again don the glove 1.

As the glove 1 can be donned and removed using just one hand with either of the methods, stains on the outer face of the glove 1 are less likely to adhere to a bare hand and/or to the clothing of the wearer.

Advantages

Because, with regard to the glove 1 according to the embodiment of the present invention, a projection image of the cuff 20 as viewed from a palm side thereof is a figure symmetrical with respect to a straight line and symmetrical with respect to the axis parallel to a direction of the protruding, the projection image increasing in width as it becomes distant from the hem portion 10*c*, the cuff 20 is highly symmetrical in a transverse direction when viewed from the palm side thereof, and increases in width as it approaches a side in which the hand is inserted. In other words, due to employing such a shape, the glove 1 can more easily have uniform frictional force along the circumference of the cuff 20, regardless of site, at a time of donning or removing the glove. Accordingly, portions having unduly high frictional force are unlikely to develop in the glove 1, thereby inhibiting the difficulty in donning or removing the glove. Furthermore, in the glove 1, the flexural rigidity of the cuff 20 is set to be greater than the flexural rigidity of the hem portion 10*c* of the glove main body 10 by no less than 1.0 gf·cm$^2$/cm. Due to thus setting the flexural rigidity of the cuff 20 to be greater than the flexural rigidity of the hem portion 10*c* of the glove main body 10, mainly the hem portion 10*c* of the glove main body 10 curves inward at a time of an area around the joining site between the cuff 20 and the glove main body 10 bending inward, making it possible to inhibit the cuff 20 from bending inward. Thus, it is possible to inhibit a case in which the hand is likely to contact each of the edges at the joining site between the cuff 20 and the glove main body 10. In view of the aforementioned points, the glove 1 according to the embodiment of the present invention is easy to don and remove.

Further, in the glove 1, configuring the cuff 20 to have the right frustum shape enables making portions having unduly high frictional force more unlikely to develop, thereby making the glove 1 even easier to don and remove.

Other Embodiments

The present invention is not limited to the above embodiments and may be carried out in various modified and improved modes in addition to the aforementioned modes.

Figure 6:
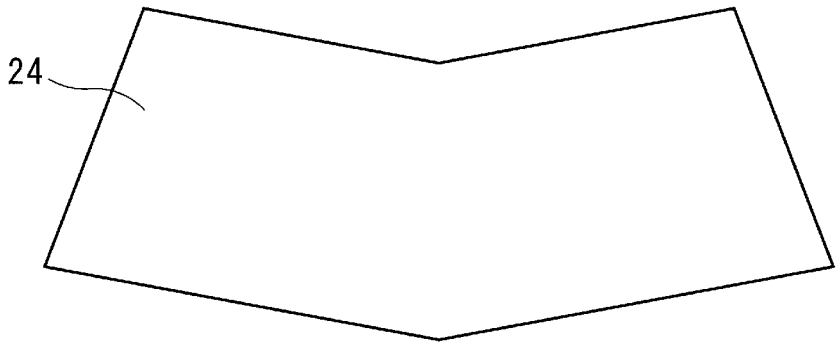
FIG. 6 is a development view of a part constituting a cuff differing from that illustrated in FIG. 4.
Figure 7:
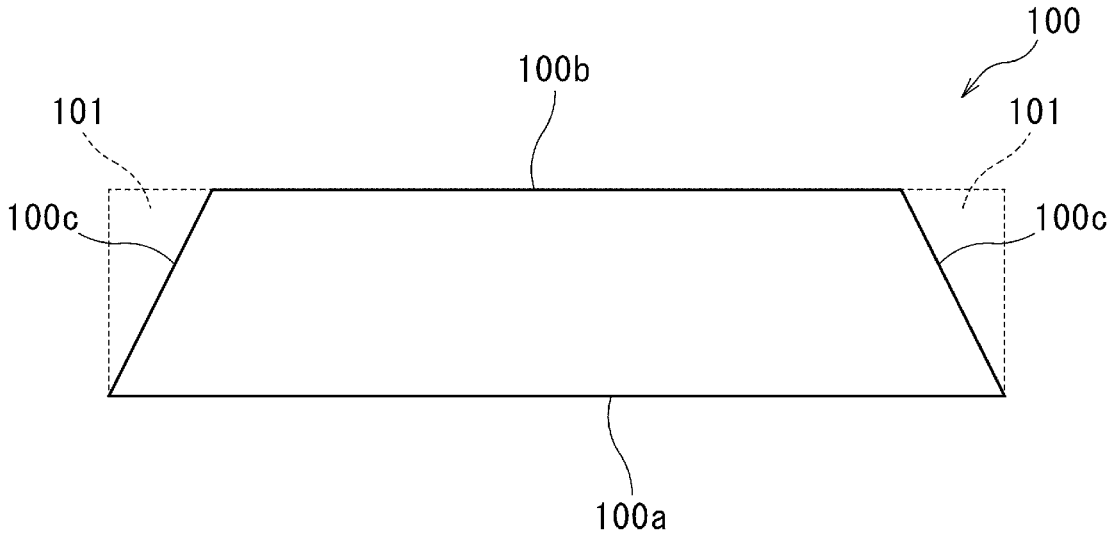
FIG. 7 is a schematic plan view illustrating a fabric constituting a conventional cuff.

In the above embodiment, the case in which the cuff has the right frustum shape is described; however, the shape of the cuff is not limited to the right frustum shape. Another shape can be employed as long as a projection image of the cuff as viewed from a palm side thereof is a figure symmetrical with respect to a straight line and symmetrical with respect to an axis parallel to a direction of the protruding, the projection image increasing in width as it becomes distant from the hem portion. For example, a cuff constituted from a part 24 of the cuff illustrated in FIG. 6 can be employed. This part 24 is constituted from two isosceles trapezoids being equivalent in shape, the two isosceles trapezoids being connected on one side such that upper bases thereof, being short sides, and lower bases thereof, being long sides, are each continuous. In this part 24, the cuff can be constructed by joining other sides of the two isosceles trapezoids together. Joining the cuff to the glove main body such that two joining portions at which the other sides are joined together are located at a border between the palm and the dorsal side of the hand enables a projection image of the cuff as viewed from a palm side thereof to be a figure symmetrical with respect to a straight line, the projection image being symmetrical with respect to an axis parallel to a direction in which the cuff protrudes. However, in the case of the cuff having the development view illustrated in FIG. 6, folding lines are formed at an obtuse angle by an upper edge at an end portion of the cuff on a glove main body side located at the two joining portions which run longitudinally between the upper edge and a lower edge. In this respect, employing the cuff having the development view illustrated in FIG. 4, for which joining with the glove main body is easy, is preferable.

In the above embodiment, the case in which the glove main body has the two coating layers (the first coating layer and the second coating layer) has been described, but a number of the coating layers is not limited to two; the number may be one, or three or more, and may be, for example, a synthetic leather or an artificial leather having a coating layer. Moreover, the glove main body not having the coating layer also falls within the intended scope of the present invention. Examples of the glove main body not having the coating layer include a glove main body made of leather, a glove main body made of a breathable synthetic leather or artificial leather and having a foam layer, and the like. However, in light of preventing liquid stains such as water, oil, and the like, the glove main body having the coating layer containing the resin or the rubber as the principal component is preferred.

In the above embodiment, the case in which the first coating layer functions as a waterproofing layer and the second coating layer functions as an antislipping layer has been described; however, the function of each coating layer is not limited hereto. It is to be noted that the antislipping layer, due to properties thereof, is arranged as an outermost layer.

Furthermore, in the above embodiment, the case in which the first coating layer and the second coating layer coat a part of the outer face of the inner glove has been described; however, for example, the first coating layer may coat all of the outer face of the inner glove. In this case, the second coating layer may coat a part of an outer face of the first coating layer, or may coat all of the first coating layer.

In the above embodiment, the case in which the glove main body and the cuff are joined by overlock sewing has been described; however, it is also possible to perform overlock sewing at a time of cutting the hem portion of the glove main body to prevent fraying and/or discomfort, and then join the glove main body and the cuff by a sewing method.

In the above embodiment, the case in which the glove main body and the cuff are joined by sewing has been described; however, the method of joining the glove main body and the cuff is not limited to sewing. The glove main body and the cuff may be joined by another method such as using an adhesive, heat sealing, welding, or the like.

In the above embodiment, the case in which the glove main body includes the organic fiber region has been described; however, the organic fiber region is not a necessary constituent, and may be left out. For example, in a case in which the inner glove itself is knitted using a yarn made of organic fiber, it is not necessary to additionally arrange the organic fiber layer.

In the above embodiment, the case in which the cuff is constituted from two parts has been described; however, the constitution of the cuff is not limited thereto. A cuff constituted from one part, a cuff constituted from three or more parts, and the like also fall within the intended scope of the present invention. It is to be noted that in order to avoid additional time taken for sewing, the number of parts is preferably two.

INDUSTRIAL APPLICABILITY

As explained in the foregoing, the glove according to the embodiment of the present invention, while having a cuff, can be easily donned and removed using just one hand.

EXPLANATION OF THE REFERENCE SYMBOLS

1 Glove
10 Glove main body
10*a* Main body portion
10*b* Finger-receiving portions
10*c* Hem portion
11 Inner glove
11*a* Organic fiber region
12 First coating layer

13 Second coating layer
20 Cuff
20*a* Inner face
21 First part
21*a* End
22 Second part
22*a* End
23 Joining portion
24 Cuff part
31 Sewing thread
32 Joining portion
S1, S2 Edges
P Piercing site
100 Fabric
100*a* Edge on arm side
100*b* Edge on wrist side
100*c* Pair of sides
101 End
110 Cuff
110*a* Arm-separating portion
110*b* Arm-aligning portion
110*c* Joining portion

What is claimed is:

1. A glove comprising:

a glove main body comprising:

a main body portion;

5 finger-receiving portions each having a bottomed cylindrical shape; and a hem portion having a cylindrical shape; and a cuff which is joined to the hem portion of the glove main body, wherein the main body portion is formed in a pouch-like shape to cover a palm and a dorsal side of a wearer's hand, the 5 finger-receiving portions extend from the main body portion to cover each of a first finger to a fifth finger of the wearer, the hem portion extends in a direction opposite to the 5 finger-receiving portions, the cuff is arranged to protrude from the hem portion in a direction opposite to the 5 finger-receiving portions, the glove main body comprises:

an inner glove being a fabric which is knitted into a glove shape, the fabric being constituted from a yarn made of fiber; and a coating layer which coats a part or all of an outer face of the inner glove, the cuff is made of a synthetic leather or an artificial leather, the glove main body and the cuff are layered atop one another and joined such that an outer face side of the glove main body comes in contact with an outer face side of the cuff, a projection image of the cuff as viewed from a palm side thereof is a figure symmetrical with respect to a straight line, the figure symmetrical with respect to the straight line being symmetrical with respect to an axis parallel to the direction of the protruding of the cuff, and the projection image increasing in width as the projection image becomes distant from the hem portion, a flexural rigidity of the cuff is greater than a flexural rigidity of the hem portion of the glove main body, and a difference between the flexural rigidities is no less than 1.0 gf $cm^2$/cm, at a joining portion between the glove main body and the cuff, a circumference length of the cuff before the joining is greater than a circumference length of the glove main body before the joining, and a difference between the circumference lengths is no less than 1 mm.

2. The glove according to claim 1, wherein the cuff has a right frustum shape.

3. The glove according to claim 1, wherein a principal component of the coating layer is a resin or a rubber, and the coating layer is joined to the cuff on the palm side thereof.

4. The glove according to claim 3, wherein the principal component of the coating layer is a nitrile-butadiene rubber or a chloroprene rubber.

5. The glove according to claim 1, wherein the cuff is constituted from at least two parts comprising joining portions which run longitudinally between upper edges and lower edges thereof.

6. The glove according to claim 1, wherein the glove main body comprises a cut-resistant yarn made of a metal or a glass fiber.

7. The glove according to claim 6, wherein the glove main body comprises an organic fiber region which is knitted with a yarn made of organic fiber, and the organic fiber region originates at an edge of the hem portion of the glove main body and continues for no less than 1 mm toward a fingertip side thereof.

8. The glove according to claim 6 or 7, wherein the glove main body and the cuff are joined by sewing, and the sewing is overlock sewing.

* * * * *